US012516464B2

(12) United States Patent
Angelini et al.

(10) Patent No.: US 12,516,464 B2
(45) Date of Patent: Jan. 6, 2026

(54) LAUNDRY TREATING APPLIANCE INCLUDING A TRANSPORT BOLT

(71) Applicant: WHIRLPOOL CORPORATION, Benton Harbor, MI (US)

(72) Inventors: Marco Angelini, Folignano (IT); Matteo Carnevale, Esanatoglia (IT); Changadevkumar Bapusaheb Desai, Pune (IN); Sara Diamanti, Castel di Lama (IT); Nicola Di Mauro, Fabriano (IT); Ajit Govind Kulkarni, Pune (IN); Mauro Mancini, Fabriano (IT); Stefano Turchi, Falconara Marittima (IT)

(73) Assignee: Whirlpool Corporation, Benton Harbor, MI (US)

( * ) Notice: Subject to any disclaimer, the term of this patent is extended or adjusted under 35 U.S.C. 154(b) by 265 days.

(21) Appl. No.: 18/137,197

(22) Filed: Apr. 20, 2023

(65) Prior Publication Data

US 2024/0352646 A1 Oct. 24, 2024

(51) Int. Cl.
*D06F 39/00* (2024.01)
*D06F 37/26* (2006.01)

(52) U.S. Cl.
CPC ..... *D06F 39/001* (2013.01); *D06F 37/267* (2013.01)

(58) Field of Classification Search
None
See application file for complete search history.

(56) References Cited

FOREIGN PATENT DOCUMENTS

| | | | |
|---|---|---|---|
| CN | 201206213 | Y | 3/2009 |
| EP | 1235988 | B1 | 12/2005 |
| KR | 101095403 | B1 | 12/2011 |
| KR | 101100308 | B1 | 12/2011 |

*Primary Examiner* — Rita P Adhlakha
(74) *Attorney, Agent, or Firm* — McGarry Bair PC

(57) ABSTRACT

A laundry treating appliance comprising a first body, a second body, and a transport bolt securing the tub to the cabinet during transportation. The first body defines an interior and has at least one wall with a first opening. The second body is located within the interior and has a second opening aligned with the first opening. The transport bolt comprises a shank with a first region and a second region.

19 Claims, 7 Drawing Sheets

LAUNDRY TREATING APPLIANCE INCLUDING A TRANSPORT BOLT

TECHNICAL BACKGROUND

The present disclosure relates to a laundry treating appliance, and more specifically to laundry treating appliance with a cabinet and a tub and having a transport bolt securing together the cabinet and tub.

BACKGROUND

Laundry treating appliances, such as washing machines, refreshers, and non-aqueous systems, can have a configuration based on a rotating container that at least partially defines a treating chamber in which laundry items are placed for treating and that can be provided within a tub. The laundry treating appliance can have a controller that implements a number of user-selectable, pre-programmed cycles of operation. Hot water, cold water, or a mixture thereof along with various treating chemistries, including detergents, can be supplied to the treating chamber in accordance with the cycle of operation.

The laundry treating appliance includes a cabinet defining an interior with the tub being suspended within the interior. The tub is free to move along at least one degree of freedom within the interior. During moving or transporting of the laundry treating appliance, a transport bolt secures the tub to the cabinet to restrain movement in the at least one degree of freedom, which can reduce the relative shifting of parts, which might have undesirable effects.

BRIEF SUMMARY

An aspect of the present disclosure relates to a laundry treating appliance comprising a first body including at least one wall with a first opening, a second body, spaced from the first body, and including a second opening aligned with the first opening, and a transport bolt comprising a unitary body with a head and a shank and selectively coupling the second body to the first body, with the shank having a first region receivable through the first opening, and a second region receivable through the first opening.

Another aspect of the present disclosure relates to a laundry treating appliance comprising a cabinet defining an interior and having at least one wall with a first tapped opening, a tub located within the interior and having a second tapped opening aligned with the first tapped opening, a transport bolt comprising a unitary body a head and a shank, with the shank having a first threaded region, threadedly coupled to the first tapped opening, the first threaded region having a first pitch, and a second threaded region, threadedly coupled to the second tapped opening, the second threaded region having a second pitch, different from the first pitch.

Another aspect of the present disclosure relates to a method of producing a laundry treating appliance, the method comprising providing a cabinet with a first opening, the cabinet having at least one wall at least partially defining an interior, providing a tub within the interior, the tub having a second opening, aligning the first opening with the second opening such that a gap is formed therebetween, coupling the tub to the cabinet by providing a first region of a transport bolt through the first opening, providing a second region of the transport bolt through the second opening, and spanning a third region of the transport bolt through at least a portion of the gap, providing the transport bolt within the laundry treating appliance such that the tub does not move from an intended position within the cabinet during transportation of the laundry treating appliance, and providing the transport bolt within the laundry treating appliance such that the transport bolt is removable after transport and/or installation of the laundry treating appliance.

DETAILED DESCRIPTION OF THE DISCLOSURE

Figure 1:
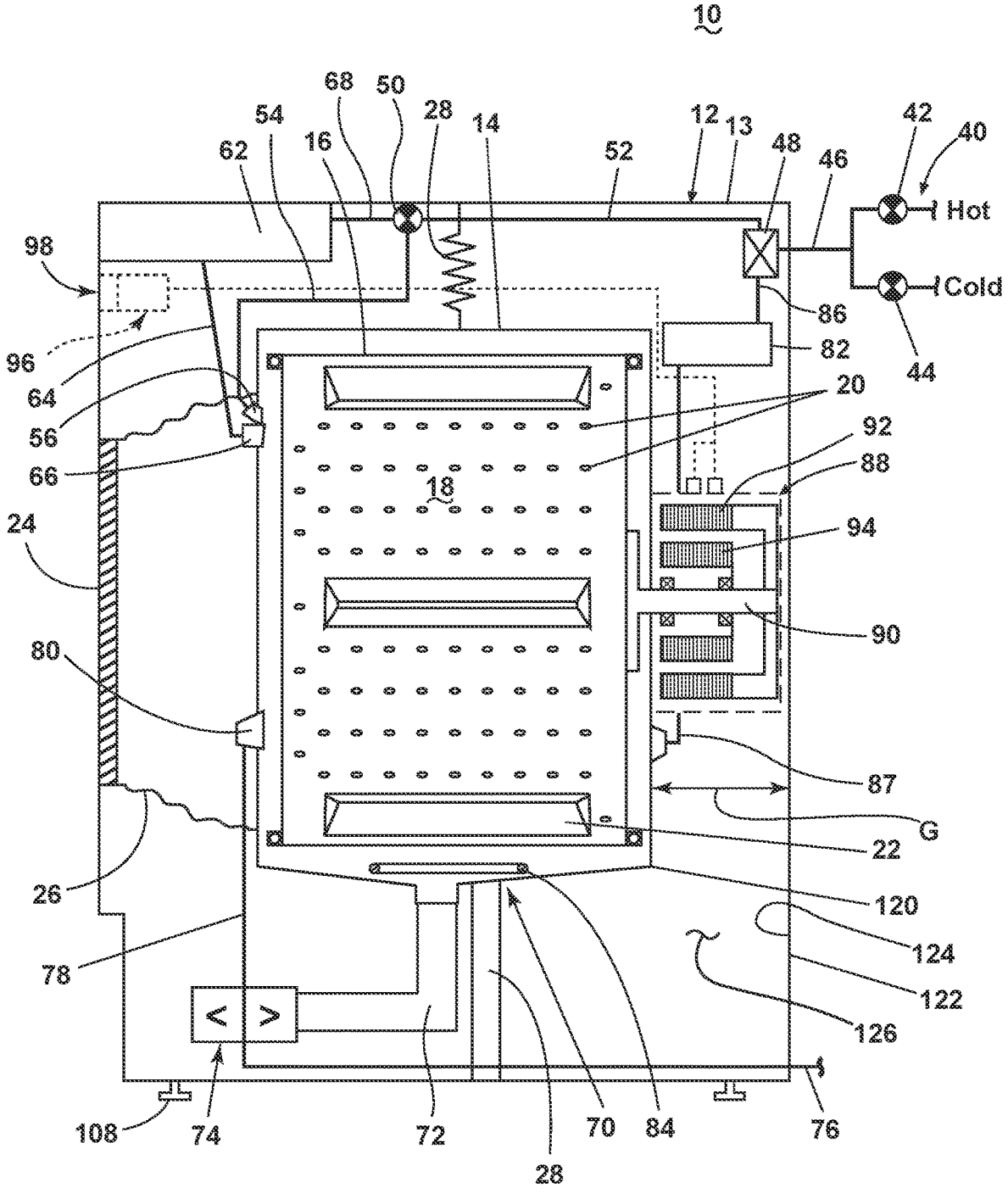
FIG. 1 is a schematic cross-sectional view of a laundry treating appliance in the form of a washing machine including a cabinet defining an interior with a tub being provided within the interior.

FIG. 1 shows a laundry treating appliance in accordance with the present disclosure, which happens to be a horizontal axis automatic clothes washing machine 10. Although much of the remainder of this application will focus on the embodiment of the horizontal axis automatic clothes washing machine 10, the present disclosure encompasses other environments, including other horizontal axis laundry treating appliances such as a laundry dryer. Also, while illustrated as a front-loading, horizontal axis laundry treating appliance, other loading configurations, such as top-loading are contemplated.

Further, other axes of rotation are contemplated. A vertical axis laundry treating appliance is contemplated in addition to the illustrated horizontal axis laundry treating appliance. For purposes of this description, the terms horizontal axis and vertical axis are used to represent the general orientation of the axis of rotation and is not meant to be limited to a perfectly horizontal or vertical axis of rotation. More accurately, the terms horizontal axis of rotation or vertical axis of rotation, when used to identify the type of laundry treating appliance, are more accurately used to describe the primary mechanism by which mechanical energy is imparted to the laundry. The horizontal axis washing machine imparts mechanical energy primarily by tumbling the laundry within the drum. That is, rotation of the drum lifts and then drops the laundry. This lifting/dropping imparts mechanical energy to the laundry. The vertical axis washing machine imparts mechanical energy via a clothes mover, such as an agitator, impeller, pulsator, auger, etc., which is rotated within the basket to affect movement of liquid in the basket or directly impact the laundry. While a laundry container is normally referred to as a drum for a horizontal axis machine and a basket for a vertical axis machine, for this disclosure, unless otherwise stated, drum and basket are interchangeable.

The laundry treating appliance of FIG. 1 is illustrated as a front-loading, horizontal-axis washing machine 10, which may include a structural support system comprising a cabinet 12 which defines a housing within which a laundry holding system resides and includes a top wall 13. The cabinet 12 may be a housing having a chassis and/or a frame, defining an interior 126 enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system 28 and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber. The tub 14 can further include a first surface 120 or otherwise a rear surface. The cabinet 12 can include a rear wall 122 with a second surface 124 confronting and space from the first surface 120 to define a gap (G) therebetween.

The laundry holding system may further include a door 24 which may be movably mounted to the cabinet 12 to selectively close both the tub 14 and the drum 16.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 and can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14.

The washing machine 10 can also be provided with a dispensing system for dispensing treating chemistry to the treating chamber 18 for use in treating the laundry according to a cycle of operation. The dispensing system can include a dispenser 62, which can be a single use dispenser, a bulk dispenser or a combination of a single use and bulk dispenser.

The dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the dispenser 62 from the supply conduit 52 by directing the second diverter mechanism 50 to direct the flow of water to a dispensing supply conduit 68.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The washing machine 10 can also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 88 for rotationally driving the drum 16. The motor 88 can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled with the drum 16 through a belt and a drive shaft 90 to rotate the drum 16, as is known in the art. Other motors, such as an induction motor or a permanent split capacitor (PSC) motor, can also be used. The motor 88 can rotationally drive the drum 16 including that the motor 88 can rotate the drum 16 at various speeds in either rotational direction. The motor 88 can be configured to rotatably drive the drum 16 in response to a motor control signal.

The washing machine 10 also includes a control system for controlling the operation of the washing machine 10 to implement one or more cycles of operation. The control system can include a controller 96 located within the cabinet 12 and a user interface 98 that is operably coupled with the controller 96. The user interface 98 can include one or more knobs, dials, switches, displays, touch screens, and the like for communicating with the user, such as to receive input and provide output. The user can enter different types of information including, without limitation, laundry treating chemistry concentration and cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller can be a microprocessor-based controller that implements control software and sends/receives one or more electrical signals to/from each of the various working components to affect the control software.

Figure 2:
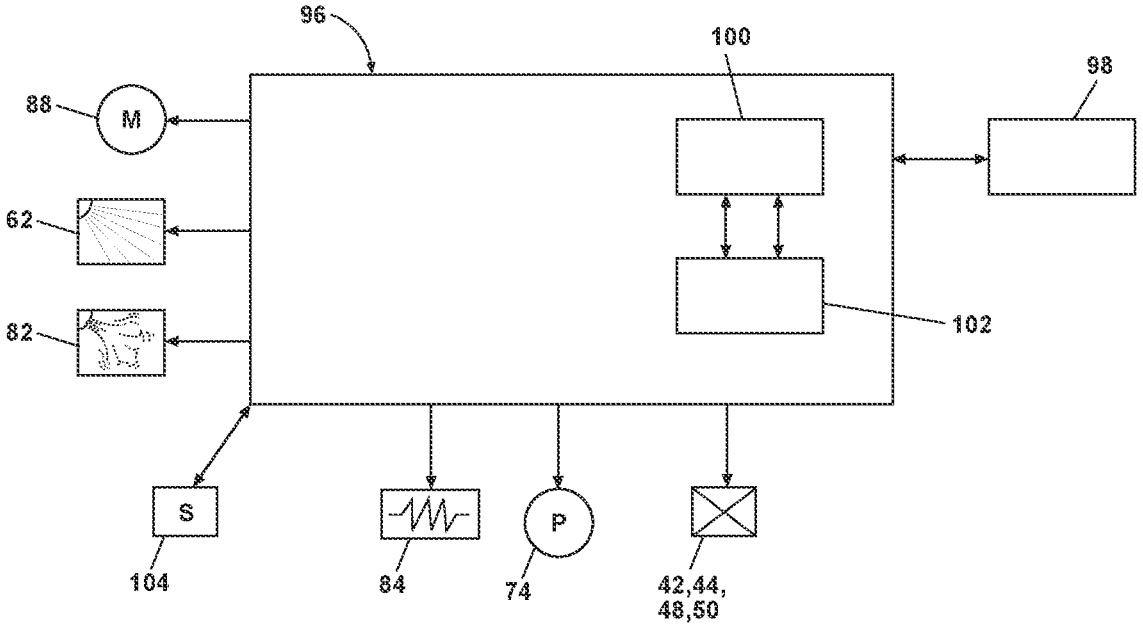
FIG. 2 is a schematic representation of a control system for controlling the operation of the laundry treating appliance of FIG. 1.

As illustrated in FIG. 2, the controller 96 can also be coupled with one or more sensors 103, 104 provided in one or more of the systems of the washing machine 10 to receive input from the sensors. Non-limiting examples of sensors 103, 104 that can be communicably coupled with the controller 96 include: a surfactant sensor, a turbidity sensor, a motor torque sensor, a pressure sensor, a conductivity sensor, a treating chamber temperature sensor, a moisture sensor, a weight sensor, a chemical sensor, a position sensor, an acceleration sensor, a speed sensor, an orientation sensor, an imbalance sensor, a load size sensor, and, which can be used to determine a variety of system and laundry characteristics, such as over-sudsing conditions.

For example, a motor torque sensor, a speed sensor, an acceleration sensor, and/or a position sensor can also be included in the washing machine 10 and can provide an output or signal indicative of the torque applied by the motor, a speed of the drum 16 or component of the drive system, an acceleration of the drum 16 or component of the drive system, and a position sensor of the drum 16. Such sensors 103, 104 can be any suitable types of sensors including, but not limited to, that one or more of the sensors 103, 104 can be a physical sensor or can be integrated with the motor and combined with the capability of the controller 96 to function as a sensor. For example, motor characteristics, such as speed, current, voltage, torque etc., can be processed such that the data provides information in the same manner as a separate physical sensor. In contemporary motors, the motors often have their own controller that outputs data for such information.

The controller 96 can be provided with a memory 101 and a central processing unit (CPU) 102. The memory 101 can be used for storing the control software that can be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 101 can also be used to store information, such as a database or table, and to store data received from one or more components or sensors 103, 104 of the washing machine 10 that can be communicably coupled with the controller 96. The database or table can be used to store the various operating parameters for the one or more cycles of operation, including factory default values for the operating parameters and any adjustments to them by the control system or by user input. Such operating parameters and information stored in the memory 101 can include, but are not limited to, threshold values, predetermined criteria, acceleration ramps, etc.

The controller 96 can be operably coupled with one or more components of the washing machine 10 for communicating with and controlling the operation of the component to complete a cycle of operation. For example, the controller 96 can be operably coupled with the motor 88, the pump 74, the dispenser 62, the steam generator 82 and the sump heater 84 to control the operation of these and other components to implement one or more of the cycles of operation.

Figure 3:
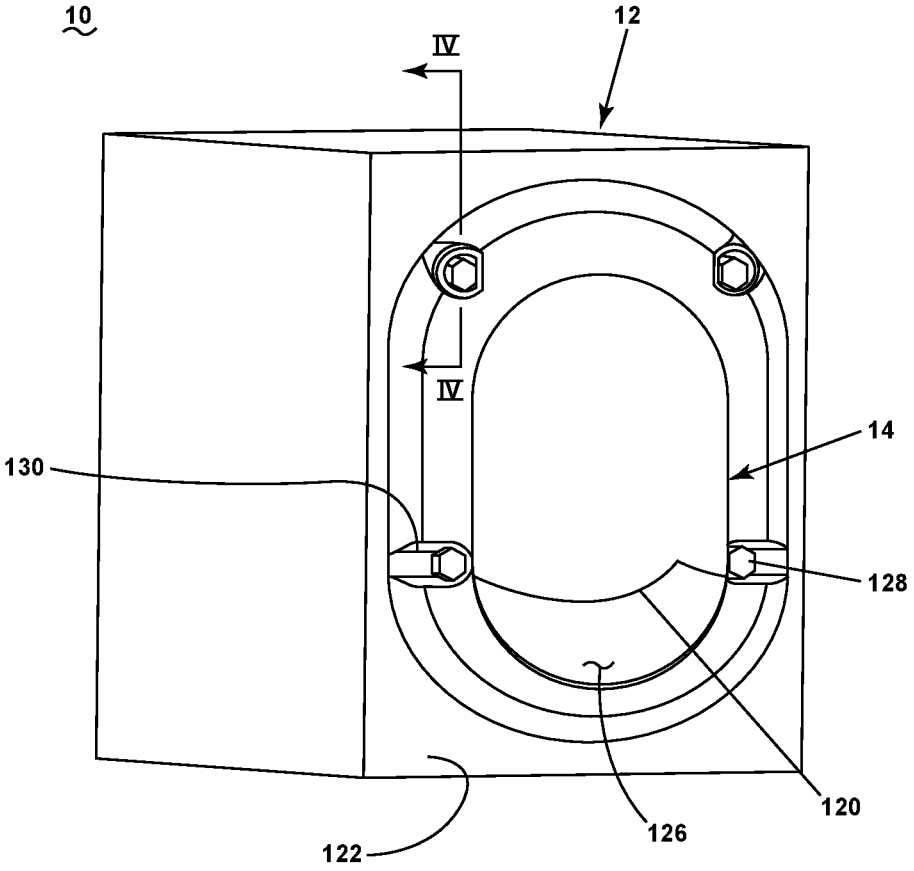
FIG. 3 is a schematic, rear perspective view of the laundry treating appliance of FIG. 1, further illustrating a transport bolt interconnecting the cabinet and the tub.

FIG. 3 is a schematic, rear perspective view of the horizontal-axis washing machine 10 of FIG. 1. While described in terms of the horizontal-axis washing machine 10, it will be appreciated that aspects described herein can be applied to any suitable laundry treating appliance. As such, the horizontal-axis washing machine 10 will hereinafter be referred to as the laundry treating appliance 10, with it being understood that the laundry treating appliance 10 can be any suitable laundry treating appliance. The laundry treating appliance 10, as illustrated, includes an oval cutout that has been removed from the laundry treating appliance 10 to illustrate a portion of the interior 126. It will be appreciated that the rear wall 122 can be continuously formed (e.g., without a cutout) or otherwise include the oval cutout or another cutout.

The laundry treating appliance 10 can include a set of transport bolts 128 that interconnect or otherwise couple the cabinet 12 to the tub 14. As a non-limiting example, the set of transport bolts 128 extend from the rear wall 122 of the cabinet 12 and into the tub 14.

The rear wall 122 can include a set of seats 130. The set of seats 130 can be sized to house a portion of a respective transport bolt of the set of transport bolts 128. There can be any number of one or more transport bolts 128 and corresponding seats 130. The seats 130 are optional and are shaped to receive the corresponding transport bolts 128 such that the transport bolts 128 do not project beyond the rear wall 122.

It is contemplated that the set of transport bolts 128 are only provided or installed on the laundry treating appliance 10 when the laundry treating appliance 10 is ready for transport. As used herein, transport can include any scenario or situation where the laundry treating appliance is not functional (e.g., not plugged into a power supply or the ready to be or otherwise moveable between two locations. Non-limiting examples of transport include delivery to a store, delivery to a consumer, moving, or the like.

The set of transport bolts 128 are used to limit the movement of the tub 14 within the interior 126 during transport. As a non-limiting example, when the set of transport bolts 128 are removed from the laundry treating appliance 10, the tub 14 is free to move within the interior 126 along at least one degree of freedom (e.g., rotationally). However, when the set of transport bolts 128 are provided with or installed in the laundry treating appliance 10, the tub 14 is anchored to the cabinet 12 such that the tub 14 cannot move along the aforementioned degree of freedom. Limiting or stopping the movement of the tub 14 during transport greatly reduces the risk of the laundry treating appliance 10 being damaged during transport of the laundry treating appliance 10 due to the tub 14 moving within the interior 126 during transport.

Figure 4:
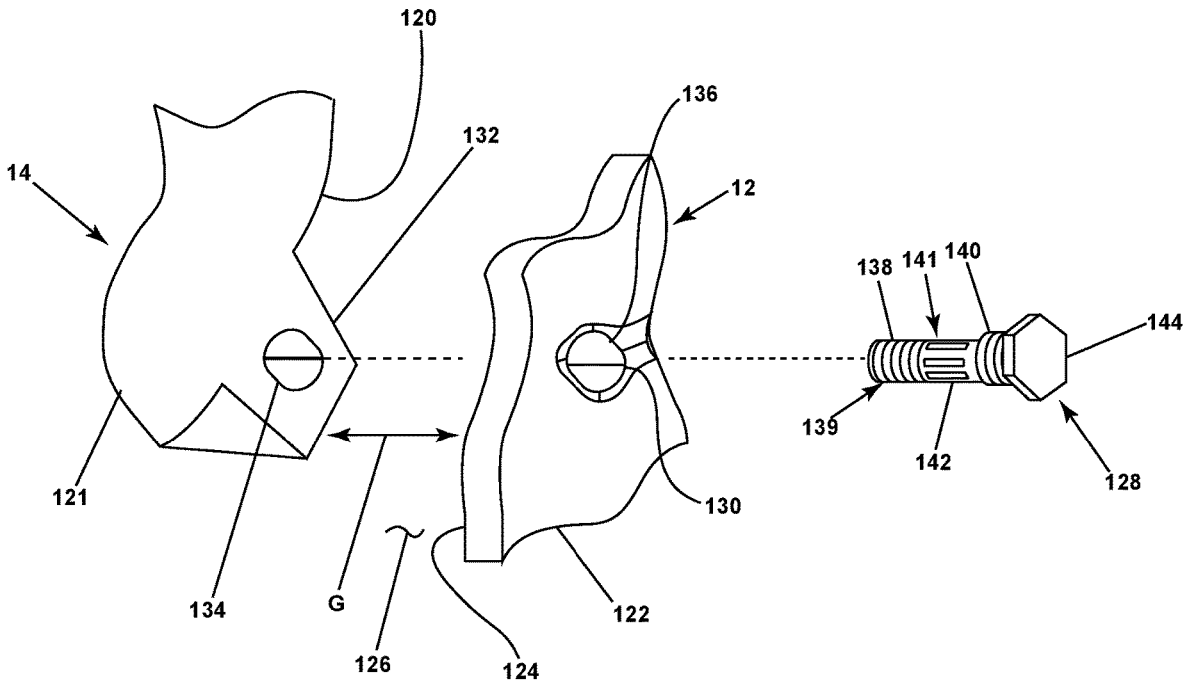
FIG. 4 is a schematic, rear perspective exploded view of a section of the laundry treating appliance of FIG. 1, further illustrating a first region, a second region and a third region of the transport bolt.

FIG. 4 is a schematic, rear perspective exploded view of a section of the laundry treating appliance 10 of FIG. 1. The illustrated section shows a single transport bolt 128 of the set of transport bolts 128. It will be appreciated that the structure for the tub 14 and the cabinet 12 to accommodate the transport bolt 128 can be applied to any portion of the tub 14 and the cabinet 12, respectively, based on the number of transport bolts of the set of transport bolts 128.

The cabinet 12 includes a first opening 136. The tub 14 includes a second opening 134. The first opening 136 is aligned with the second opening 134. The first opening 136 is spaced from the second opening 134 to define the gap (G) therebetween.

The first opening 136 can be included within a plurality of first openings 136 provided about the cabinet 12. The second opening 134 can be provided within a plurality of second openings 134 provided about the tub 14. A total number of first openings of the plurality of first openings 134 can correspond to a total number of second openings of the plurality of second openings 136. Each single first opening corresponds to a single respective second opening. The plurality of first openings 136 can be spaced evenly or non-evenly about the cabinet 12. The transport bolt 128 can be included within a plurality of transport bolts 128 with a total number of transport bolts 128 corresponding to a total number of first openings 136 of the plurality of first openings 136.

The tub 14 can include a set of mounts 132 extending from a main body 121 of the tub 14. It will be appreciated that the main body 121 can be defined by a generally cylindrical portion of the tub 14 that houses the drum 16 (FIG. 1). The second opening 136 can be provided on the mount 132 or alternatively on a portion of the main body 121. In the case where the tub 14 includes a plurality of second openings 136, there can be a plurality of mounts 132 corresponding to a total number of second openings in the plurality of second openings 134.

Each first opening of the plurality of first openings 136 can include a respective seat of the set of seats 130. Alternatively, at least one first opening of the plurality of first tapped openings 136 can be provided along a portion of the rear wall 122 without the set of seats 130.

The transport bolt 128 can include a head 144 and a shank 139. The shank 139 can include a first region 138, a second region 140, and a third region 141. The third region 141 interconnects the first region 138 and the second region 140. The third region 141 can include a set of ribs 142 spaced about the transport bolt 128. The head 144 can be sized to fit within a respective seat of the set of seats 130.

The first region 138 and the second region 140 can be coupled to the cabinet 12 and the tub 14, respectively, through any suitable coupling method. As a non-limiting example, the second region 140 can be a threaded region and the second opening 134 can be a tapped opening such that the second region 140 can be threaded into a respective portion of the second opening 134. As a non-limiting example, the first region 138 can be a threaded region and the first opening 136 can be a tapped opening such that the first region 138 can be threaded into a respective portion of the first opening 136. The third region 141 can be a region of the shank 139 without threads such that the third region 141 can define a non-threaded region. Alternatively, the third region can include threads such that the transport bolt 128 includes continuous threads along the shank 139. In other words, all sections or regions of the shank 139 may include threads, such as the same thread pattern (e.g. same pitch dimensions) along the entire length of the shank 139, for example.

While described in terms of the transport bolt 128 extending between the cabinet 12 and the tub 14, it will be appreciated that the transport bolt 128 can extend between any suitable two or more bodies of the laundry treating appliance 10. As a non-limiting example, the transport bolt 128 can extend between a first body having the first opening 136 and at least a second body having the second opening 136. The transport bolt 128 can further extend into or to a third body, with the second body being provided between the first body and the third body. The third body can be any suitable body such as, but not limited to, the drum 16 (FIG. 1).

Figure 5:
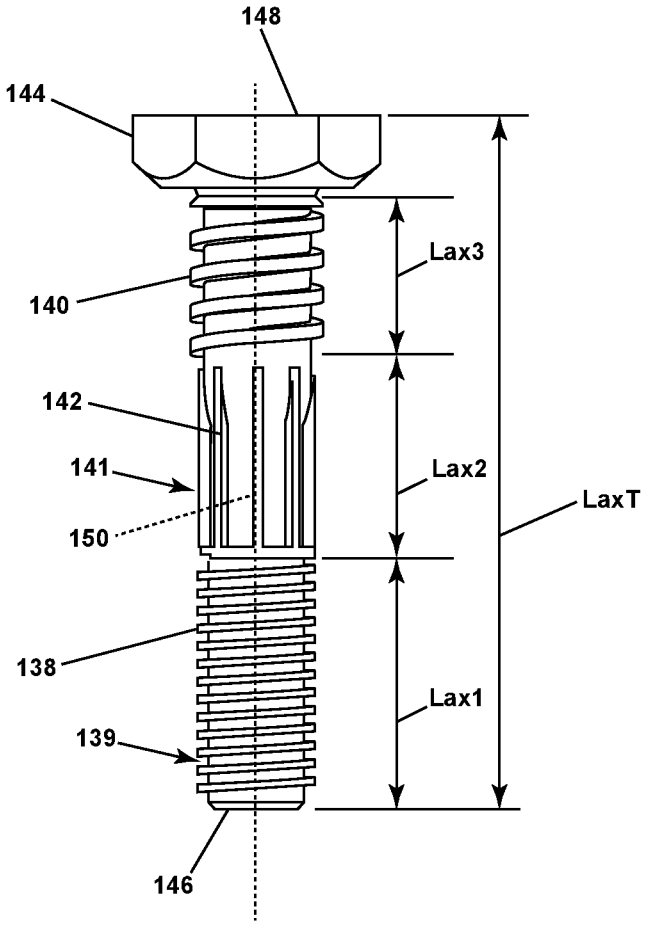
FIG. 5 is a schematic, side view of the transport bolt of FIG. 3, further illustrating the first region, the second region, and the third region.

FIG. 5 is a side view of the transport bolt 128 of FIG. 3. The transport bolt 128 extends along a centerline axis 150 between a first end 146 and a second end 148.

From bottom to top, the first region 138 extends axially from the first end 146 and to the third region 141, the third region 141 extends axially from the first region 138 to the second region 140, the second threaded region extends axially from the third region 141 to the head 144, and the head 144 extends axially from the first region 138 to the second end 148. The first region 138 can coincide with or be provided axially displaced from the first end 146. The set of ribs 142 of the third region 141 can extend axially from the first region 138. The set of ribs 142 can extend fully between the first region 138 and the second region 140 or terminate axially prior to the second region 140, as illustrated. The set of ribs 142 are circumferentially spaced evenly or non-evenly about the centerline axis 150. The second region 140 extends axially from the third region 141 and to the head 144. The head 144 can define the second end 148 of the transport bolt 128. It will be appreciated that the second region 140, however, can extend fully to the second end 148 such that the head 144 is only defined by the second end 148 and does not include a thickness as illustrated. In other words, the shank 139 can extend between the first end 146 and the second end 148.

In the non-limiting example where the first region 138 is a first threaded region and the second region 140 is a second threaded region, the first region 138 includes a first pitch between adjacent threads, and the second region 140 includes a second pitch between adjacent threads. The first pitch can be different from the second pitch. As a non-limiting example, the first pitch can be smaller than the second pitch.

The transport bolt 128 extends a total axial distance (LaxT) along the centerline axis 150. The first region 138 extends a first axial distance (Lax1) along the centerline axis 150. The third region 141 extends a second axial distance (Lax2) along the centerline axis 150. The second region 140 extends a third axial distance (Lax3) along the centerline axis 150.

At least two of the first axial distance (Lax1), the second axial distance (Lax2), and the third axial distance (Lax3) can be equal or non-equal. As a non-limiting example, the first axial distance (Lax1) can be larger than the third axial distance (Lax3). As a non-limiting example, the second axial distance (Lax2) can be larger than the third axial distance (Lax3) but smaller than the first axial distance (Lax1). As a non-limiting example, the sum of the first axial distance (Lax1), the second axial distance (Lax2) and the third axial distance (Lax3) can be less than or equal to the total axial distance (LaxT).

The set of ribs 142 define a set of raised projections that extend axially, with respect to the centerline axis 150, along at least a portion of the third region 141. The set of ribs 142 can be used to strengthen the transport bolt 128 when mounted to the laundry treating appliance 10. As a non-limiting example, when mounted to the laundry treating appliance 10, a bending moment due to the weight of the tub 14 can be applied to the transport bolt 128. The set of ribs 142 can extend axially across a portion of the transport bolt 128 and thus be used to reduce the effect of the bending moment across the transport bolt 128.

Figure 6:
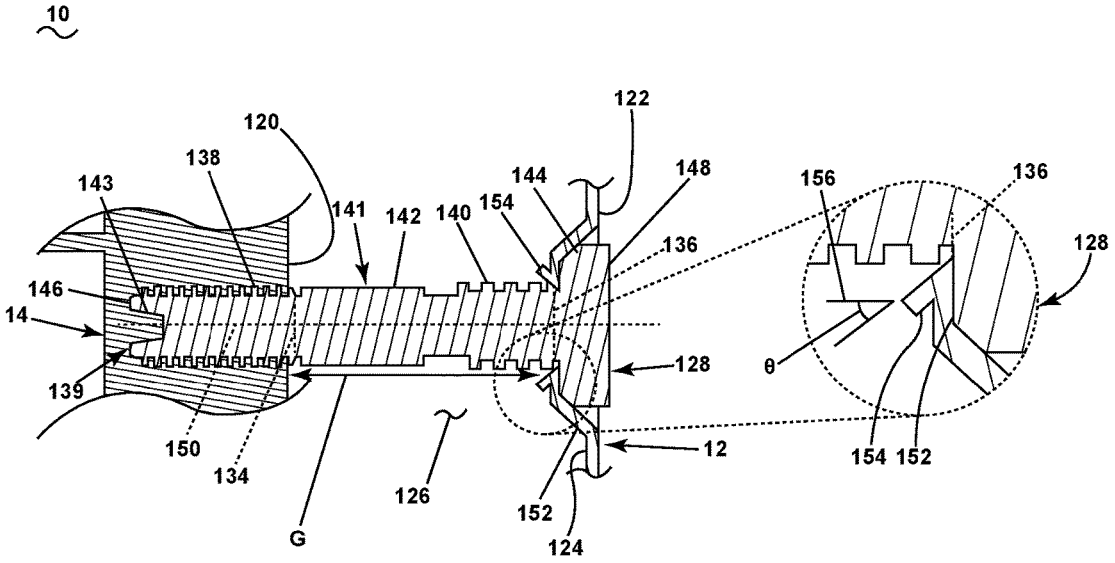
FIG. 6 is a schematic cross-sectional side view of a portion of the laundry treating appliance as seen from sectional line IV-IV of FIG. 3, further illustrating a flange of the cabinet.

FIG. 6 is a schematic cross-sectional side view of a portion of the laundry treating appliance 10 as seen from sectional line IV-IV of FIG. 3. As illustrated, the transport bolt 128 is received within the first opening 136 and the second opening 134, thus coupling the tub 14 to the cabinet 12.

When received within the first opening 136 and the second opening 134, at least the set of ribs 142 of the third region 141 are provided entirely within the gap (G) between the first surface 120 and the second surface 124. It will be appreciated that at least a portion of the first region 138 of the second region 140 can also be provided within the gap (G). It will be appreciated that the total distance that the gap (G) spans can be equal to, at least, a total distance that the third region 141 extends along the shank 139.

The rear wall 122 of the cabinet 12 includes a first flange 152 and a second flange 154 at least partially defining the second opening 134. The first flange 152 and the second flange 154, together, define a bent portion of the cabinet 12. The first flange 152 can extend axially inwardly, with respect to the centerline axis 150, to define the seat 130. It will be appreciated, however, that if the seat 130 is not included that the first flange 152 can also be excluded from the rear wall 122. The second flange 154 extends axially inwardly from the first flange 152 or the rear wall 122 and radially outward from the centerline axis 150 with respect to the centerline axis 150. The second flange 154 extends at a flange angle (θ) with respect to a projection 156 of the centerline axis 150. The flange angle (θ) can be any suitable angle. As a non-limiting example, the flange angle (θ) can be any suitable angle that is not 90 degrees.

The transport bolt 128 can further include a tooth 143 at the first end 146. The tooth 143 can be used to lock the transport bolt to the laundry treating appliance 10. As a non-limiting example, when received within the second opening 134, the tooth 143 can dig or otherwise bite into the material of the tub 14. In other words, the transport bolt 128 can be threaded into the material of the tub 14. It will be appreciated that at least a portion of the tub 14 can include a malleable material such that the tooth 143 can be fed into the malleable material and be received within the malleable material, effectively securing the transport bolt 128 to the tub 14. It is contemplated that in instances where the transport bolt 128 spans to a third body (e.g., the drum 16), the third body can include the malleable material that the tooth 143 is fed into. It is further contemplated that in such a scenario, the third body may not include an opening and that the transport bolt 128 can be fed directly into the third body. It will be further appreciated that the second opening 134 can be defined entirely by malleable material such that the transport bolt is fed into a portion of the tub 14 including the malleable material to create the second opening 134. In other words, the second opening 134 can be created only after threading the transport bolt 128 into the malleable material of the tub 14.

Figure 7:
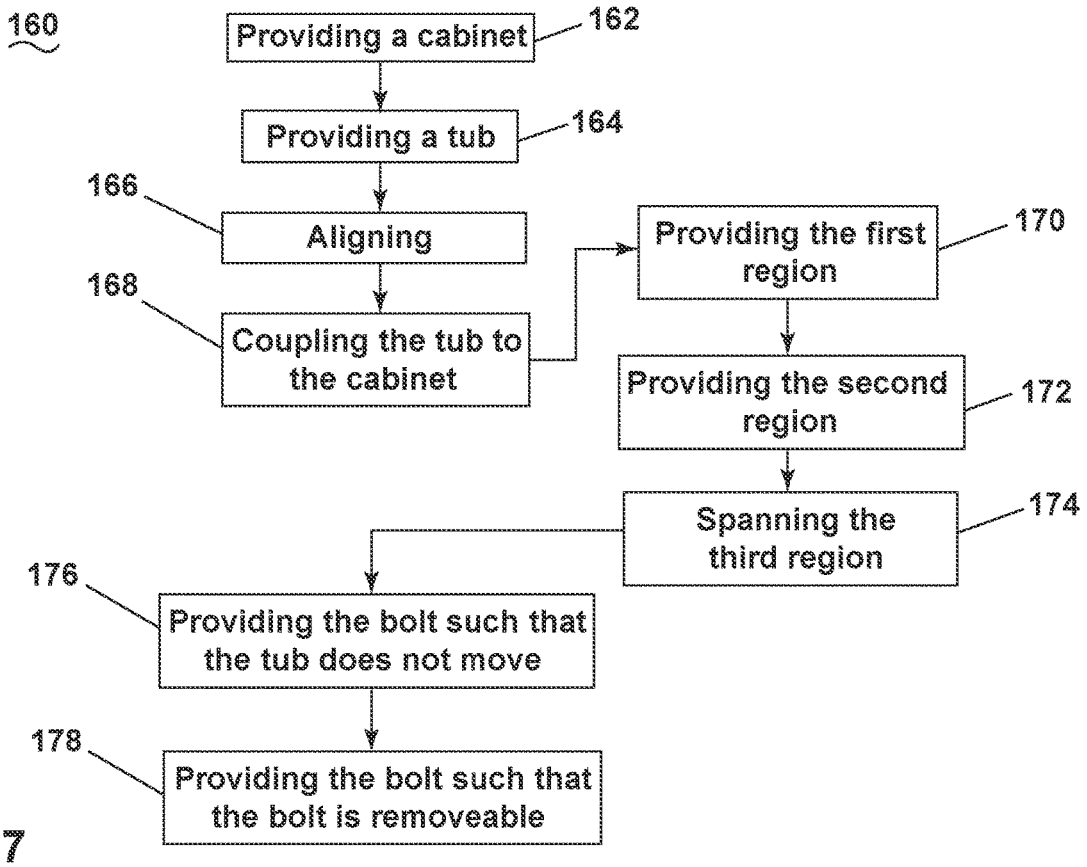
FIG. 7 is a method of producing the laundry treating appliance including the transport bolt of FIG. 3.

FIG. 7 is a method 160 of producing the laundry treating appliance 10 including the transport bolt 128 of FIG. 3. The method 160 is described in terms of the laundry treating appliance 10, therefore, reference will be made to the parts of the laundry treating appliance 10 described in FIGS. 1-6.

The method 160 can begin by providing the cabinet 12 with the first set of openings 136, at 162. It is contemplated that the cabinet 12 can be formed with the set of first openings 136 (e.g., cast with or additively manufactured with the set of first openings 136) or the set of first openings 136 can be machined into respective portions of the cabinet 12. The tub 14 can be provided within the interior 126 of the cabinet 12 and include the set of second openings 134 along the first surface 120 of the tub 34, at 164. It is contemplated that the tub 14 can be formed with the set of second openings 134 (e.g., cast with or additively manufactured with the set of second openings 134) or the set of second openings 134 can be machined into respective portions of the tub 14. The first opening 136 can then be aligned with the second opening 134, at 164.

The tub 14 can be coupled to the cabinet 12, at 168. Coupling the tub 14 to the cabinet 12 can be done by providing each first region 138 of the set of transport bolts 128 into a respective first opening of the set of first openings 136, at 170, providing each second region 140 of the set of transport bolts 128 into a respective second opening of the set of second openings 134, at 172, and spanning each third region 141 of the set of transport bolts 128 through a respective portion of the gap (G), at 174. The set of transport bolts 128 can be provided within the laundry treating appliance 10, at 176, such that the tub 14 does not move from an intended position within the cabinet 12 during transport of the laundry treating appliance 10. The set of transport bolts 128 can be provided within the laundry treating appliance 10, at 178, such that the set of transport bolts 128 are removable after transport and installation of the laundry treating appliance 10. As used herein, installation can refer to any suitable permanent or semi-permanent state of the laundry treating appliance 10 where the laundry treating appliance 10 is functional or non-functional. As a non-limiting example, installation can refer to the laundry treating appliance 10 being installed in a consumer's house or area such that the laundry treating appliance 10 is fully functional. As a non-limiting example, installation can refer to the laundry treating appliance 10 being installed as a display such that a consumer can visualize the laundry treating appliance 10 without the laundry treating appliance 10 being functional.

It will be understood that the method 160 is flexible and the method 160 is illustrated merely for illustrative purposes. For example, the sequence of steps depicted is for illustrative purposes only, and is not meant to limit the method 160 in any way, as it is understood that the steps can proceed in a different logical order or additional or intervening steps can be included without detracting from the method 160 as described herein.

As a non-limiting example, the method 160 can include providing the cabinet 12 with the set of first openings 136 as a set of first openings. The method 160 can include providing the tub 14 with the set of second openings 134 as a set of second openings. The method 160 can include coupling the tub 14 to the cabinet 12 by threading the second region 140 to the second opening. The method 160 can include coupling the tub 14 to the cabinet 12 by threading the first region 138 to the first opening. The method 160 can include providing the first region 138 with a first pitch and the second region 140 with a second pitch. The method 160 can including sizing the first pitch different from the second pitch.

As a non-limiting example, the method 160 can include providing the third region 141 with the plurality of ribs 142 circumferentially about the centerline axis 150. The method 160 can include providing the plurality of ribs 142 axially along the third region 141 from the second region 140 and towards the first region 138 with the plurality of ribs 142 terminating axially prior to the first region 138.

As a non-limiting example, the method 160 can include receiving the tooth 143 within a material of the tub 14. The method 160 can include locking the transport bolt 128 to the tub 14 through use of the tooth 143.

Benefits of the present disclosure include a relatively less complex version of coupling the tub to the cabinet during transportation when compared to a conventional method of coupling the tub to the cabinet during transportation. For example, the conventional method requires a transport assembly that is used to prevent movement of the tub within the cabinet by temporarily coupling the tub to the cabinet. The transportation assembly utilizes a metal screw with at least one plastic collar surrounding a portion of the metal screw: Metal screw is threaded into a portion of the tub, while the plastic collar snaps into a portion of the cabinet and extends into the interior. The conventional transport assembly is bulky and requires multiple pieces. The plastic collar is further used to provide structural support of the transportation assembly. The method of coupling the tub to the cabinet during transportation, as described herein, however, utilizes a transport bolt with the first region, the second region and the third region. The bolt being defined by a unitary body that couples the tub to the cabinet. In comparison with the conventional transportation assembly, the transport bolt is a much less complex system, which further means a reduced burden and cost of manufacture along with assembly.

To the extent not already described, the different features and structures of the various aspects of the present disclosure can be used in combination with each other as desired. That one feature may not be illustrated in all of the aspects of the disclosure is not meant to be construed that it cannot be, but is done for brevity of description. Thus, the various features of the different aspects of the present disclosure can be mixed and matched as desired to form new aspects, whether or not the new aspects are expressly described. All combinations or permutations of features described herein are covered by this disclosure.

While the aspects of the present disclosure have been specifically described in connection with certain specific aspects thereof, it is to be understood that this is by way of illustration and not of limitation. Reasonable variation and modification are possible within the scope of the forgoing disclosure and drawings without departing from the spirit of the present disclosure which is defined in the appended claims. Hence, specific dimensions and other physical characteristics relating to the aspects of the present disclosure are not to be considered as limiting, unless expressly stated otherwise.

Further aspects of the disclosure are provided by the subject matter of the following clauses:

A laundry treating appliance comprising a first body including at least one wall with a first opening, a second body, spaced from the first body, and including a second opening aligned with the first opening, and a transport bolt comprising a unitary body with a head and a shank and selectively coupling the second body to the first body, with the shank having a first region receivable through the first opening, and a second region receivable through the first opening.

A laundry treating appliance comprising a cabinet defining an interior and having at least one wall with a first tapped opening, a tub located within the interior and having a second tapped opening aligned with the first tapped opening, a transport bolt comprising a unitary body a head and a shank, with the shank having a first threaded region, threadedly coupled to the first tapped opening, the first threaded region having a first pitch, and a second threaded region, threadedly coupled to the second tapped opening, the second threaded region having a second pitch.

A method of producing a laundry treating appliance, the method comprising providing a cabinet with a first opening, the cabinet having at least one wall at least partially defining an interior, providing a tub within the interior, the tub having a second opening, aligning the first opening with the second opening such that a gap is formed therebetween, coupling the tub to the cabinet by providing a first region of a transport bolt through the first opening, providing a second region of the transport bolt through the second opening, and spanning a third region of the transport bolt through at least a portion of the gap, providing the transport bolt within the laundry treating appliance such that the tub does not move from an intended position within the cabinet during transportation of the laundry treating appliance, and providing the transport bolt within the laundry treating appliance such that the transport bolt is removable after transport and/or installation of the laundry treating appliance.

The laundry treating appliance of any preceding clause, wherein the first region is a first threaded region with a first pitch and the second region is a second threaded region with a second pitch.

The laundry treating appliance of any preceding clause, wherein the first pitch is different from the second pitch.

The laundry treating appliance of any preceding clause, wherein the shank further comprises a third region interconnecting the first region and the second region.

The laundry treating appliance of any preceding clause, wherein the shank extends along a centerline axis and the third region includes a plurality of ribs circumferentially spaced relative to the centerline axis and extending axially along at least a portion of the third region.

The laundry treating appliance of any preceding clause, wherein the plurality of ribs extend axially along at least a portion of the third region.

The laundry treating appliance of any preceding clause, wherein the plurality of ribs begin at the second region and terminate axially prior to the first region.

The laundry treating appliance of any preceding clause, wherein the transport bolt extends along a centerline axis and the first region extends a first axial distance along the centerline axis, the second region extends a second axial distance along the centerline axis, the third region extends a third axial distance along the centerline axis, and at least two of the first axial distance, the second axial distance, and the third axial distance are non-equal.

The laundry treating appliance of any preceding clause, wherein the second axial distance is smaller than the first axial distance.

The laundry treating appliance of any preceding clause, wherein the third axial distance is larger than the second axial distance but smaller than the first axial distance.

The laundry treating appliance of any preceding clause, wherein the first body is a cabinet defining an interior and the second body is a tub provided within the interior.

The laundry treating appliance of any preceding clause, further comprising a third body, with the second body being provided between the first body and the third body.

The laundry treating appliance of any preceding clause, herein the shank comprises a tooth provided at an end of the shank opposite the head, with the shank tooth being receivable within a material of the second body.

The laundry treating appliance of any preceding clause, wherein the first body includes a main body and at least one mount extending from the main body, with the second tapped opening being provided along the at least one mount.

The laundry treating appliance of any preceding clause, wherein the first opening is included within a plurality of first openings and the second opening is included within a plurality of second openings corresponding to a total number of first openings of the plurality of first openings.

The laundry treating appliance of any preceding clause, wherein the first pliantly of openings are non-evenly spaced about the first body The laundry treating appliance of any preceding clause, wherein the shank further comprises a non-threaded region located between and interconnecting the first threaded region and the second threaded region.

The laundry treating appliance of any preceding clause, wherein the first pitch is different from the second pitch.

The method of any preceding clause, further comprising providing the cabinet with the first opening as a first tapped opening.

The method of any preceding clause, further comprising providing the tub with the second opening as a second tapped opening.

The method of any preceding clause, further comprising coupling the tub to the cabinet by threading the second region to the second tapped opening.

The method of any preceding clause, further comprising coupling the tub to the cabinet by threading the first region to the first tapped opening.

The method of any preceding clause, further comprising providing the first region of the transport bolt through the first opening, with the first region being a first threaded region defined by a first pitch, and providing the second region of the transport bolt through the second opening, with the second region being a second threaded region defined by a second pitch.

The method of any preceding clause, further comprising sizing the first pitch to be different from the second pitch.

The method of any preceding clause, wherein the transport bolt extends along a centerline axis and the method further comprises providing the third region with a plurality of ribs circumferentially about the centerline axis.

The method of any preceding clause, further comprising providing the plurality of ribs axially along the third region from the second region and terminating axially prior to the first region.

The method of any preceding clause, further comprising receiving a tooth of the transport bolt within a material of the tub.

The method of any preceding clause, further comprising locking the transport bolt to the tub through the tooth.

What is claimed is:

1. A laundry treating appliance comprising:

a first body including at least one wall with a first opening;

a second body, spaced from the first body, and including a second opening aligned with the first opening; and a transport bolt comprising a unitary body with a head and a shank and selectively coupling the second body to the first body, with the shank having:

a first region defining a first threaded region with a first pitch, the first region receivable through the first opening; and a second region defining a second threaded region with a second pitch, the second region receivable through the first opening;

wherein the first pitch is different from the second pitch.

2. The laundry treating appliance of claim 1, wherein the shank further comprises a third region interconnecting the first region and the second region.

3. The laundry treating appliance of claim 2, wherein the shank extends along a centerline axis and the third region includes a plurality of ribs circumferentially spaced relative to the centerline axis and extending axially along at least a portion of the third region.

4. The laundry treating appliance of claim 3, wherein the plurality of ribs extend axially along at least a portion of the third region.

5. The laundry treating appliance of claim 4, wherein the plurality of ribs begin at the first region and terminate axially prior to the second region.

6. The laundry treating appliance of claim 3, wherein the plurality of ribs are configured to reduce the effect of a bending moment across the transport bolt.

7. The laundry treating appliance of claim 2, wherein the transport bolt extends along a centerline axis and:

the first region extends a first axial distance along the centerline axis;

the second region extends a second axial distance along the centerline axis;

the third region extends a third axial distance along the centerline axis; and at least two of the first axial distance, the second axial distance, and the third axial distance are non-equal.

8. The laundry treating appliance of claim 7, wherein the second axial distance is smaller than the first axial distance.

9. The laundry treating appliance of claim 8, wherein the third axial distance is larger than the second axial distance but smaller than the first axial distance.

10. The laundry treating appliance of claim 1, wherein the first body is a cabinet defining an interior and the second body is a tub provided within the interior.

11. The laundry treating appliance of claim 1, further comprising a third body, with the second body being provided between the first body and the third body.

12. The laundry treating appliance of claim 1, wherein the shank comprises a tooth provided at an end of the shank opposite the head, with the tooth being receivable within a material of the second body.

13. The laundry treating appliance of claim 1, wherein the first body includes a main body and at least one mount extending from the main body, with the second opening being provided along the at least one mount.

14. The laundry treating appliance of claim 1, wherein the first opening is included within a plurality of first openings and the second opening is included within a plurality of second openings corresponding to a total number of first openings of the plurality of first openings.

15. The laundry treating appliance of claim 14, wherein the first plurality of openings are non-evenly spaced about the first body.

16. The laundry treating appliance of claim 1, further comprising:

a cabinet defining an interior and having the at least one wall with the first opening defined as a first tapped opening, the cabinet being the first body; and a tub located within the interior and having the second opening defined as a second tapped opening aligned with the first tapped opening, the tub being the second body.

17. The laundry treating appliance of claim 16, wherein the shank further comprises a non-threaded region located between and interconnecting the first threaded region and the second threaded region.

18. The laundry treating appliance of claim 16, wherein the first pitch is different from the second pitch.

19. A method of producing the laundry treating appliance of claim 1, the method comprising:

providing a cabinet defining the first body with the first opening, the cabinet having the at least one wall at least partially defining an interior;

providing a tub within the interior, the tub defining the second body and having the second opening;

aligning the first opening with the second opening such that a gap is formed therebetween;

coupling the tub to the cabinet by:

providing the first region of the transport bolt through the first opening;

providing the second region of the transport bolt through the second opening; and spanning a third region of the transport bolt through at least a portion of the gap;

providing the transport bolt within the laundry treating appliance such that the tub does not move from an intended position within the cabinet during transportation of the laundry treating appliance; and providing the transport bolt within the laundry treating appliance such that the transport bolt is removable after transport and/or installation of the laundry treating appliance.

* * * * *